US010486452B2

(12) United States Patent
Lohwaser et al.

(10) Patent No.: US 10,486,452 B2
(45) Date of Patent: Nov. 26, 2019

(54) FLEXIBLE PACKAGING SUBSTRATES COMPROMISING THERMALLY-STABLE PRINTS

(71) Applicant: AMCOR FLEXIBLES SELESTAT SAS, Selestat (FR)

(72) Inventors: Wolfgang Lohwaser, Gailingen (DE); Steven Welvaert, Sint-Amandsberg (BE); Georgia-Venetsana Stenou, Kantza Pallini (GR); Tony Malfait, Rollegem-Kapelle (BE)

(73) Assignee: AMCOR FLEXIBLES SELESTAT SAS, Selestat (FR)

( * ) Notice: Subject to any disclaimer, the term of this patent is extended or adjusted under 35 U.S.C. 154(b) by 0 days.

(21) Appl. No.: 16/079,677

(22) PCT Filed: Feb. 20, 2017

(86) PCT No.: PCT/EP2017/053783
§ 371 (c)(1),
(2) Date: Aug. 24, 2018

(87) PCT Pub. No.: WO2017/144409
PCT Pub. Date: Aug. 31, 2017

(65) Prior Publication Data

US 2019/0047310 A1 Feb. 14, 2019

(30) Foreign Application Priority Data

Feb. 26, 2016 (EP) ..... 16157573

(51) Int. Cl.

| | |
|---|---|
| ***B41M 7/00*** | (2006.01) |
| ***B41M 1/30*** | (2006.01) |
| ***B41M 5/00*** | (2006.01) |
| ***G03G 13/20*** | (2006.01) |
| ***G03G 15/00*** | (2006.01) |

(52) U.S. Cl.
CPC ..... *B41M 7/0081* (2013.01); *B41M 1/30* (2013.01); *B41M 5/0011* (2013.01); *B41M 5/0064* (2013.01); *G03G 13/20* (2013.01); *G03G 15/6591* (2013.01)

(58) Field of Classification Search
CPC .... B41M 7/0081; B41M 1/30; B41M 5/0011; B41M 5/0064; G03G 13/20; G03G 15/6591
See application file for complete search history.

(56) References Cited

U.S. PATENT DOCUMENTS

| | | | |
|---|---|---|---|
| 5,674,922 | A | 10/1997 | Igarashi et al. |
| 5,777,576 | A | 7/1998 | Zur et al. |
| 5,819,667 | A | 10/1998 | Rodi |
| 5,889,084 | A | 3/1999 | Roth |
| 6,162,570 | A | 12/2000 | Maess et al. |
| 6,529,288 | B1 | 3/2003 | Miyazaki |
| 6,539,858 | B2 | 4/2003 | Aoyama et al. |
| 6,608,986 | B2 | 8/2003 | Bartscher et al. |
| 7,886,665 | B2 | 2/2011 | Biro et al. |
| 2002/0119295 | A1 | 8/2002 | Speer et al. |
| 2003/0021961 | A1* | 1/2003 | Ylitalo ..... B41M 7/0081 428/195.1 |
| 2005/0019533 | A1 | 1/2005 | Mossbrook et al. |
| 2005/0187309 | A1 | 8/2005 | Wantanabe |
| 2006/0000545 | A1 | 1/2006 | Nageli et al. |
| 2007/0085983 | A1 | 4/2007 | Ko et al. |
| 2008/0118746 | A1 | 5/2008 | Klenk |
| 2008/0218570 | A1 | 9/2008 | Kovacs et al. |
| 2010/0136300 | A1 | 6/2010 | Watanabe |
| 2011/0256478 | A1 | 10/2011 | Bernsdorf et al. |
| 2013/0233189 | A1 | 9/2013 | Wittmann et al. |
| 2015/0116432 | A1 | 4/2015 | Chretien et al. |
| 2015/0184005 | A1 | 7/2015 | Howald et al. |

FOREIGN PATENT DOCUMENTS

| | | | |
|---|---|---|---|
| EP | 0741644 | A1 | 8/1995 |
| EP | 1159142 | | 9/2000 |
| EP | 2133210 | A2 | 12/2009 |
| EP | 2305758 | A1 | 4/2011 |
| EP | 2720877 | | 12/2012 |
| JP | S57011083 | A | 1/1982 |
| JP | 10-324836 | A | 12/1998 |
| WO | WO 95/16572 | A1 | 6/1995 |
| WO | WO 97/31071 | | 8/1997 |

* cited by examiner

*Primary Examiner* — Lamson D Nguyen
(74) *Attorney, Agent, or Firm* — Reinhart Boerner Van Deuren P.C.

(57) ABSTRACT

The present invention is related to a flexible packaging substrate comprising one or more crosslinked ink layers and to a method for the production of said printed substrate.

20 Claims, No Drawings

FLEXIBLE PACKAGING SUBSTRATES COMPROMISING THERMALLY-STABLE PRINTS

FIELD OF THE INVENTION

The present invention is related to a printed packaging substrates and to a method for the production of flexible packaging substrates comprising thermally-stable digital prints.

STATE OF THE ART

Within the flexible packaging business, decreased time to market deliveries from brand-owner to end-customer has been an on-going trend for years. The customization of packaging and dedicated promotional campaigns towards the consumer require a capability from the converter to respond fast, efficiently and flexibly with short-order printing campaigns. Also during the packaging design phase, the production of mockup samples, with a printed representative for the final product, requires fast and flexible printing technology.

The term "flexible packaging" is intended to refer to thin film or foil materials which are generally supplied in a roll format, printed on, and then rolled up again after printing. Exemplative flexible packaging substrates include plastics and polymer films in general, metallized polymer films, metal foils, laminates thereof, and laminates of polymer films with paper, polymer-coated papers and the like. Flexible packaging substrates can be used, for example, to pack food, pharmaceuticals, cosmetics, or tobacco.

The art of package printing and decoration is dominated by liquid-ink processes that are based on drying or curing individual ink layers through the evaporation of water or volatile organic compounds. These processes consume high amounts of energy and often negatively affect the environment due to emission of solvent or greenhouse gases in the atmosphere.

The introduction of radiation-curable inks, such as ultraviolet (UV) and electron beam (EB) curable inks, helps to reduce this kind of emissions.

Two main technologies are used in radiation-curable inks. The first uses free radical species to initiate the polymerization of reactive functional groups, more particularly ethylenically unsaturated double bonds. The most commonly used reactive groups are (meth)acrylate and more particularly acrylate groups, as disclosed for example in WO 97/31071, US 2015/0116432 and US 2015/0184005.

One limitation of radical-curable (meth)acrylate based inks is the flexibility of the cured ink. This is generally linked to the shrinkage associated with acrylate materials after curing that renders the ink film brittle and not suitable for applications where high flexibility is required.

Another technology used in radiation curing is the generation of very strong acids to initiate the cationic polymerization of reactive functional groups such as for example, cyclic ethers such as oxirane or oxethane, preferably alicyclic epoxides, allyl ethers and vinyl ethers, as disclosed for example in U.S. Pat. No. 5,674,922 and US 2010/0136300.

The benefits of cationic curing over radical curing include low shrinkage and therefore good adhesion and excellent flexibility. Furthermore, cationic systems are not sensitive towards oxygen inhibition, which makes substantially complete (at or about 100%) monomer conversion possible. This means that cationic technology allows the curing of thick pigmented ink films more easily than free radical technology.

The use of radiation-curable inks for use in flexible packaging has been extensively described in the literature.

US 2008/0218570 A1 discloses methods and devices for forming high-quality, high throughput, ultraviolet or electron beam curable gel ink images on flexible substrates for packaging applications.

EP 2 133 210 A1 and EP 2 720 877 A1 disclose a method for printing and decorating packaging materials, such as paper, paper board and various flexible polymer films by electron-beam exposure of plural layers of curable inks and coatings which do not substantially change their viscosity during the printing process. The inks and coating are essentially free of volatile components before, during and after exposure to electron-beam irradiation. The method involves applying multiple layers of ink and an optional coating onto a substrate. Thereafter, these layers are simultaneously exposed with electron-beam radiation to cause ethylenically unsaturated components to polymerize or crosslink such that they become dried.

EP 0 741 644 A1 discloses a system and method for the printing of substrates for use in food packaging and, more particularly, a flexographic printing system and method for applying and curing radiation cured inks to a flexible, heat shrinking web employing a combination of UV radiation and EB radiation.

EP 2 305 758 A1 relates to a laminate comprising a) a substrate comprising a thermoplastic polymer, b) a single- or multi-layer ink film and/or varnish film comprising a printing ink or a printing varnish, comprising a binder with a non-radiation-curing aromatic polycarbonate and a solvent comprising at least one radiation-curing monomer, which is selected from the group consisting of acrylates, methacrylates, vinyl ethers and nitrogen-containing compounds with an ethylenic double bond, wherein the binder is dissolved in the solvent and the solvent is bound in chemically cross-linked form in the printing ink or printing varnish after curing.

US 2002/119295 A1 discloses an article including a first and second outer surfaces, printing an image on the first outer surface and applying a radiation-curable varnish on the first outer surface so as to cover at least a portion of the image.

EP 1 159 142 A1 discloses a printed packaging material in which a printed image is disposed on a primary surface. That image includes two primary components. The first is at least one marking containing a pigment. The second is a pigment-free coating which overlies the outermost marking. The coating is made from materials which can polymerize and/or crosslink when exposed to ionizing radiation. After the film is exposed to such radiation, the coating hardens to form a protective layer over the printed markings.

US 2013/0233189 A1 discloses a flexible substrate whereby a radiation-curable ink is applied to the substrate and an overcoat layer is applied on the cured ink.

Cationically curable inks have been reported in for example JP 10-324836, U.S. Pat. No. 5,889,084 and US 2005/187309 A1.

Among the drawbacks of radiation-curable inks, the complication of the printing process and the generation of low molecular weight compounds, jeopardizing their use for food and pharmaceutical packaging, may be cited.

In addition to the conventional printing technologies applied in the flexible packaging, such as heliogravure and flexographic printing, new technologies emerged in the past decades and became more or less successful. Key-decision parameters for investments, and the determining success of the technology in some markets, are investment costs, machine speeds, attainable web widths, pre-press preparation time, availability of suitable colors, flexibility to change designs, printing quality, ink encourage to the substrates, product safety aspects of the inks, stability of the inks in terms of temperature and UV light.

Among these new technologies, digital printing such as for example ink-jet printing and liquid electrography, is most noticeable.

Digital printing devices and methods are known in the printing arts and are generally described, for example, in U.S. Pat. Nos. 6,608,986; 6,529,288; 6,539,858; 6,162,570; 5,819,667 and 5,777,576.

A technology which gained widespread attention in flexible packaging is the digital offset technology or liquid electrography. Digital printing is intrinsically flexible and fast in changing designs because no physical printing plates are applied. The image remains purely digital.

In general, digital offset technology involves creating an image on a photoconductive surface by means of a laser, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged particles in a carrier liquid can be brought into contact with the selectively charged photoconductive surface. The charged particles adhere to the image areas of the latent image while the background areas remain clean. The image is then transferred to a print substrate directly or, more commonly, by being first transferred to an intermediate transfer member, which can be a soft swelling blanket, and then to the print substrate. Ink transfer is forced by an applied electrical field and carrier ink liquid is evaporated from the blanket. The hot-melted ink is adhered to the substrate by means of pressure and tackiness. The process is repeated for every color. Principally, the ink transfers to the substrate without change and without penetrating into the substrate. Hence, the resulting image quality is very high and appears to be independent from the substrate characteristics.

Variations of this method utilize different ways for forming the electrostatic latent image on a photoreceptor or on a dielectric material.

Electrographic printing on plastic, paper or metal is for example disclosed in US 2011/0256478.

The inks, particularly those developed for liquid electrography, are designed to form high resolution, uniform gloss, sharp image edges and thin image layers and in general comprise carrier liquid, resin and colorant. Typical carrier liquids can include a mixture of a variety of different agents, such as surfactants, dispersants, co-solvents, viscosity modifiers, and/or other possible ingredients.

A major limitation of flexible substrates, printed by liquid electrography, is the thermal stability of the prints based on the conventional inks. Particularly, in direct contact sealing applications, the print at the surface of the substrate, in direct contact with the sealing jaws of a flexible packaging machine, suffer from the limited thermal stability of the inks. Depending on packaging speeds and applications, typical temperature ranges, on vertical and horizontal form fill seal machines are between 120 and 200° C. Lack of heat resistance of the inks after sealing results in color changes and design deformations due to ink softening and ink flowing under the pressure of the sealing jaws.

A typical solution to overcome this problem is to apply surface protective coatings as disclosed in for example EP 1 159 142 A1; US 2005/019533 A1; US 2007/085983 A1; US 2008/118746 A1 and US 2013/0233189 A1.

Limitations to this approach is the lack of inter-coat adhesion between the coating and the ink, and the risk of changing the high gloss, high optical quality and aspect of the inks after application of the coating. Moreover, for the particular case of solvent- or water-based protective coatings, solvent and/or water removal require in a heat sensitive operation step.

Aim of the Invention

The present invention aims to provide a flexible packaging comprising digital prints and a method for the production of the printed flexible packaging, said printed flexible packaging presenting specific advantages over the above-mentioned prior art.

SUMMARY OF THE INVENTION

The present invention discloses a flexible packaging substrate comprising one or more crosslinked ink layers, wherein the concentration of ethylenically unsaturated groups or alicyclic epoxides in said ink layers is less than 0.05 meq/g, preferably less than 0.03 meq/g, more preferably less than 0.01 meq/g, most preferably less than 0.005 meq/g.

Preferred embodiments of the present invention disclose one or more of the following features:

- the flexible packaging substrate is free of an additional layer, protecting the one or more crosslinked ink layers;
- the flexible packaging substrate comprises a primer layer sandwiched between the crosslinked ink layers and the substrate;
- the total layer thickness of primer and ink layer(s) is comprised between 0.4 and 4 μ, preferably between 0.6 and 3.5 μ, more preferably between 0.8 and 3 μ;
- the layer thickness of the primer is comprised between 0.01 and 0.5 μ, preferably between 0.05 and 0.4 μand most preferably between 0.1 and 0.3 μ.

The present invention further discloses a method for forming a printed flexible packaging substrate comprising the steps of:

a) providing a flexible packaging substrate;
b) applying at least one digital print by a digital printing process of at least one ink composition, said ink composition being substantially free of (meth)acrylic double bonds and/or cycloaliphatic epoxy groups;
c) subjecting the digital print to an electron beam irradiation.

Preferred embodiments of the method for forming the printed flexible substrate disclose one or more of the following features:

- the at least one ink composition is substantially free of components comprising molecular structures with dangling and/or end-standing ethylenically unsaturated double bonds;
- the flexible packaging substrate is plasma treated, preferably corona plasma treated;
- the method comprises the additional step of applying a primer composition before initiating step b);
- the digital printing process of step b) is liquid electrographic printing;

the electron beam irradiation dose in step c) is at least 15 kGy, preferably at least 18 kGy, more preferably at least 20 kGy;

the electron beam irradiation dose in step c) is comprised between 20 and 100 kGy, preferably between 25 and 80 kGy, more preferably between 30 and 60 kGy;

the electron beam irradiation in step c) is performed at an oxygen concentration of less than 300 ppm, preferably less than 250 ppm, more preferably less than 200 ppm, most preferably less than 150 ppm;

the flexible packaging substrate of step a) comprises polyethylene terephthalate, high-density polyethylene, oriented polypropylene, oriented polyamide, polystyrene or paper;

the primer composition comprises one or more polyacrylamide(s);

the ink formulation comprises one or more (meth)acrylic (co)polymer(s) resin(s);

the ink formulation comprises:

from 20 to 95% by weight of hydrocarbon carrier liquid, from 5 to 80% by weight of one or more (meth)acrylic (co)polymer(s) resin(s), from 10 to 50% by weight of one or more carboxyl-functional ethylene comprising copolymer(s) co-resin(s) and from 0.1 to 80% by weight of one or more colorants;

the method comprises an additional lamination step of the flexible packaging substrate to a seal layer;

the method comprises a step of heat sealing the printed flexible substrate or the laminate in a heat sealing assembly at a temperature comprised between 100 and 250° C., preferably between 110 and 230° C., more preferably between 120 and 220° C.

The present invention further discloses a flow pack comprising the flexible packaging substrate.

DESCRIPTION OF THE INVENTION

The present invention discloses a flexible packaging substrate comprising thermally-stable digital prints, preferably obtained from liquid electrographic printing, said thermal stability being obtained by subjecting said prints, to electron beam irradiation.

Thermal stability of the digital prints is a prerequisite for heat-sealing, particularly in direct contact applications wherein the inks, at the surface of the substrate comes in direct contact with the sealing jaws of the packaging machine. Lack of heat resistance of the prints, after sealing results in color changes and design deformations due to ink softening and flowing under influence of the sealing jaws.

The inventors have surprisingly found that digital prints, preferably obtained from liquid electrographic printing of conventional ink formulations, not qualified as UV or electron beam curable inks, comprising (meth)acrylic copolymer resins and being substantially free of (meth)acrylic double bonds and/or alicyclic epoxides, are rendered thermally-stable through electron beam irradiation.

The flexible packaging substrates comprising the electron beam irradiated digital ink allow for heat sealing without the need of an additional protective layer on top of said prints.

The components composing the inks for being used in the present invention are substantially free of dangling or end-standing ethylenically unsaturated functional groups such as (meth)acryl, vinyl-, allyl-, and fumarate functional groups.

By dangling ethylenically unsaturated groups, the present invention means functional groups not incorporated into the molecular backbone, such as for example in unsaturated polyesters or in butadiene comprising (co)polymers.

By substantially free of ethylenically unsaturated groups the present invention means that the concentration of ethylenically unsaturated groups is less than 0.2 meq/g, preferably less than 0.1 meq/g, more preferably less than 0.05 meq/g, most preferably less than 0.01 meq/g.

By substantially free of alicyclic epoxides, the present invention means that the concentration of alicyclic epoxides is less than 0.2 meq/g, preferably less than 0.1 meq/g, more preferably less than 0.05 meq/g, most preferably less than 0.01 meq/g.

Preferably, the ink formulations for being used in the present invention are free of (meth)acrylic double bonds and/or alicyclic epoxides.

Preferably, the ink formulations for being used in the present invention do not comprise components comprising dangling and/or end-standing ethylenically unsaturated functional groups such as vinyl-, allyl-, and fumarate functional groups.

Prior-art resins specially developed for UV and electron beam curing in general are characterized by a concentration of ethylenically unsaturated groups or of alicyclic epoxides higher than 1.0 meq/g and even higher than 1.5 meq/g, the high concentration being sought for reactivity reasons.

Despite the substantial absence of such ethylenically unsaturated groups or of alicyclic epoxides, in the inks used in the present invention, the electron beam irradiation crosslinks the polymer chains, wherein the crosslinks preferably are carbon carbon crosslinks.

The carbon-carbon crosslinks of the electron beam crosslinked ink of the present invention preferably are characterized in that the carbon atoms are tertiary or quaternary carbon atoms.

More preferably, the carbon—carbon crosslinks are of the type $(R^1)_2\ R^2C—C(R^1)_2\ R^3$ wherein:

$R^1$ is a (meth)acrylic copolymer segment, $R^2$ is a hydrogen atom or a (meth)acrylic copolymer segment, $R^3$ is a hydrogen atom, a methyl group or a (meth)acrylic copolymer segment, as determined by Fourier Transformed InfraRed Spectroscopy.

The concentration of residual ethylenically unsaturated groups or alicyclic epoxides in crosslinked inks, obtained from irradiation of inks designed for crosslinking under influence of UV or EB, and comprising significant concentrations of ethylenically unsaturated groups or alicyclic epoxides, is higher than 0.05 meq/g, more preferably higher than 0.1 meq/g, most preferably higher than 0.2 meq/g.

Crosslinked conventional UV and EB inks are characterized in that they comprise residual ethylenically unsaturated groups and/or alicyclic epoxides, resulting from an incomplete conversion due to viscosity increase upon increasing the crosslinking degree.

The concentration of ethylenically unsaturated groups or alicyclic epoxides and the degree of conversion may be determined by combining titrations, such as for example iodometric titrations, with Fourier-transformed infrared spectroscopy.

The concentration of ethylenically unsaturated groups or alicyclic epoxides in conventional inks crosslinked on a substrate according to the method of the present invention is lower than 0.05 meq/g, preferably lower than 0.03 meq/g, more preferably lower than 0.01 meq/g, most preferably lower than 0.005 meq/g.

Preferably, the conventional inks crosslinked on a substrate according to the method of the present invention are free of ethylenically unsaturated groups and alicyclic epoxides.

The liquid inks for being used in the present invention preferably comprise a carrier liquid, a resin, a co-resin polymer and a colorant.

The co-resin preferably comprises an ethylene acrylic acid co-polymer, a maleic anhydride polymer having polyethylene grafted to the polymer, and combinations thereof. The amount of co-resin is comprised between 10 and 50% by weight, preferably between 10 and 40% by weight more preferably between 10 to 20% by weight of the ink formulation.

The resin preferably comprises (co)-polymers of (meth) acrylic acid; co-polymers of (meth)acrylic acid and alkyl (meth)acrylate; co-polymers of ethylene and (meth)acrylic acid; co-polymers of ethylene and alkyl(meth)acrylate; co-polymers of ethylene, (meth)acrylic acid and alkyl(meth) acrylate; co-polymers of ethylene and vinyl acetate; co-polymers of ethylene, (meth)acrylic acid and vinyl acetate; co-polymers of ethylene, alkyl(meth)acrylate and vinyl acetate; co-polymers of ethylene, (meth)acrylic acid, alkyl (meth)acrylate and vinyl acetate; co-polymers of (meth) acrylic acid and vinyl acetate; co-polymers of alkyl(meth) acrylate and vinyl acetate; co-polymers of (meth)acrylic acid, alkyl(meth)acrylate and vinyl acetate; polymers such as for example polyethylene; polystyrene; isotactic polypropylene; polyesters; polyvinyl toluene; polyamides; styrene/butadiene copolymers; epoxy resins; low molecular weight ethylene-acrylic acid ionomers and combinations thereof.

The amount of resin is comprised between 5 and 80% by weight, preferably between 10 and 60% by weight, more preferably between 15 and 40% by total weight of the ink formulation.

The carrier liquid preferably comprises a hydrocarbon selected from the group consisting of an (iso)paraffinic hydrocarbon, an aliphatic hydrocarbon, an isomerized aliphatic hydrocarbon, a branched chain aliphatic hydrocarbon, an aromatic hydrocarbon, a de-aromatized hydrocarbon, a halogenated hydrocarbon, a cyclic hydrocarbon, a functionalized hydrocarbon and combinations thereof. Preferablyn the carrier is 3,5,7-trimethyldecane.

The amount of carrier liquid is comprised between 20 and 95% by weight, preferably between 40 and 90% by weight, more preferably between 60 to 80% by weight of the ink formulation.

The colorants are organic and/or inorganic colorants. The colorants may comprise cyan colorants, magenta colorants, yellow colorants, violet colorants, orange colorants, green colorants, black colorants, and combinations thereof. The amount of colorant is comprised between 0.1 and 80% by weight of the ink formulation.

The ink formulation further may comprise charge adjuvants, such as for example aluminum tristearate and charge director such as for example sulfonic acids or salts thereof. Charge adjuvants are in general used in amounts comprised between 0.1 and 5% by weight preferably between 0.5 and 4% by weight, more preferably between 1 to 3% by weight of the ink formulation while charge directors in general are used in an amount comprised between 0.001 to 1% by weight of the ink formulation.

The flexible packaging substrate preferably comprises one or more film(s) of natural polymeric material, e.g. cellulose or synthetic polymeric material e.g. a polymer formed from alkylene monomers such as polyethylene or polypropylene, polyethylene terephthalate (PET), polyvinylchloride, polycarbonate, polystyrene and styrene-butadiene. In some examples, the substrate may comprise or be biaxially orientated polypropylene (BOPP).

In some examples, the substrate may comprise a cellulosic paper, which may be coated or uncoated cellulosic paper. A coated cellulosic paper includes, but is not limited to, a cellulosic paper coated with a non-cellulosic material.

The surface intended to receive the digital print first may be subjected to a physical compatibilisation treatment such as a plasma treatment, preferably a corona plasma treatment, a flame treatment or the like in order to modify its surface energy. Another option is the application of a primer on the substrate. This primer application can also be preceded by a physical surface treatment.

The primer for being used in the present invention may be applied through digital printing. The primer preferably comprises a carrier fluid and a resin wherein the carrier is preferably a hydrocarbon as disclosed above and wherein the resin preferably is selected from the group consisting of cellulose, dextrin, maltose monohydrate, polyacrylic acid, polyvinylalcohol, styrene maleic anhydride copolymer, maleimide copolymer, polyacrylamide, sucrose octaacetate, sucrose benzoate and combinations thereof. Preferably, the primer for being used in the present invention comprises polyacrylamide.

The term polyacrylamide includes all (alk)acrylamide homopolymers as well as copolymers and functionalized polyacrylamides. The polyacrylamides may be anionic, cationic or nonionic. Various monomers, preferably ethylenically unsaturated monomers may be copolymerized with (alk)acrylamide monomers to form the polyacrylamides.

The flexible packaging substrate is provided with a digital print preferably obtained from liquid electrographic printing followed by an electron beam irradiation.

The flexible packaging substrate of the present invention comprises a primer and one or more ink layers, digitally printed on at least one side of at least one layer or film composing said flexible substrate; wherein the total layer thickness of primer and ink layer(s) is comprised between 0.4 and 4 μ, preferably between 0.6 and 3.5 μ, more preferably between 0.8 and 3 μ and wherein the layer thickness of the primer is about 0.2 μ.

In the digital printing machine, the substrate is loaded into the priming unwinder, where it is corona treated, to achieve better wetting and ink adhesion. In a next step, a primer is applied to enable covalent bonding between the substrate and the ink. The primer is dried in the drying station, whereupon it passes into the printing engine. The substrate comprising the digital print subsequently is subjected to electron beam bombardment.

Electron energies are comprised between 10 and 300 keV, preferably between 20 and 250 keV, preferably between 30 and 200 keV.

The irradiation dose received by the digitally-printed ink is comprised between 15 and 100 kGy, preferably between 20 and 80 kGy, more preferably between 30 and 60 kGy.

The electron beam irradiation of the digital print is performed in an oxygen-poor region obtained through the application of a vacuum or through the use of an inert gas blanket such as a nitrogen blanket.

By oxygen-poor medium, the present invention means an oxygen concentration less than 300 ppm, preferably less than 250 ppm, more preferably less than 200 ppm, most preferably less than 150 ppm or even less than 100 ppm.

After electron beam bombardment of the digitally-printed substrate, said substrate can be further processed into a laminate, which subsequently is heat-sealed at a temperature comprised between 100 and 250° C., preferably between 110 and 230° C., more preferably between 120 and 220° C. at a pressure comprised between 20 and 120 N/cm$^2$, preferably between 20 and 110 N/cm$^2$, more preferably between 40 and 100 N/cm$^2$.

EXAMPLES

The following illustrative examples are merely meant to exemplify the present invention but is not destined to limit or otherwise define the scope of the present invention.

Example 1

A polyethylene terephthalate (PET) 12 μ film was treated by Corona (400 W) and subsequently introduced into the HP 20000 Indigo digital printing system where it was provided with a colorless digital primer Digiprime® 050 from Michelman at a layer thickness of about 0.2 μ and a cyan ink layer, at a layer thickness of about 1 μ, was printed thereon.

The digitally-printed PET film was then transferred to a vacuum electron beam processing device.

The electron beam gun has a deflection system which is computer-controlled and has been programmed in a manner that the gun, was radiating onto the drum, normally used as a coating drum. The printed film, passing over this coating drum, was irradiated by the electron beam gun. The deflection system was programmed to allow the electron beam scanning over an area of 200 mm (winding direction)×400 mm (cross direction) and therefore radiating this area. By passing the web with a speed of 15 m/min through this zone, the ink was irradiated for 0.6 seconds. The electron beam gun was operated at an acceleration voltage of 35 kV, resulting in electrons with an energy of 35 keV. The emission current was 0.42 A, resulting in a total radiation power of 15 kW is scanning over an area.

The electron beam irradiated digitally-printed PET samples were laminated. The lamination was carried out with the use of an aromatic adhesive UK2640/H6800 against a cast-polypropylene 80 μm thick film as the sealant layer.

The PET/PP laminates were sealed, outside to outside, at temperatures of 150° C., 180° C., 200° C., 210 and 220° C., respectively at a pressure of 3.5 bar for 0,6 s with two heated jaws.

At an irradiation dose of 10 kGy, the digital print showed defects, such as ink removal, ink shrinkage and gloss change, at sealing temperatures from 150 to 220° C. Said defects completely disappeared for an irradiation dose of 18 kGy and higher.

Example 2

Example 1 was repeated, wherein the cyan ink was substituted by respectively black ink, magenta ink, orange ink, violet ink, white ink and yellow ink.

At an irradiation dose of 10 kGy the digital prints of the respective colors showed similar defects as in example 1. Said defects disappeared once an irradiation dose of 18 kGy or higher was applied.

Example 3 (Comparative Example)

Example 2 was repeated, yet omitting electron beam irradiation. For all colors, severe print defects were observed for sealing temperatures of 150° C. and higher.

Example 4 (Comparative Example)

Example 2 was repeated wherein the respective digital prints were subjected to electron beam irradiation and wherein the irradiation dose was limited to 15 kGy. For all colors, severe print defects were observed for sealing temperatures of 200° C. and higher.

Example 5

Example 1 was repeated wherein the PET film was replaced by a 30 μ-thick polymer coated paper. Similar results as for Example 1 were observed.

The invention claimed is:

1. A flexible packaging substrate comprising one or more digitally-printed electron-beam crosslinked ink layers, wherein the concentration of ethylenically unsaturated groups and alicyclic epoxides in said ink layers is less than 0.05 meq/g, preferably less than 0.03 meq/g, more preferably less than 0.01 meq/g, most preferably less than 0.005 meq/g, the crosslinked ink layers being the top surface of the flexible packaging substrate.

2. The flexible packaging substrate of claim 1, being free of an additional layer, protecting said one or more crosslinked ink layers.

3. The flexible packaging substrate of claim 1, comprising a primer layer sandwiched between the crosslinked ink layers and the substrate.

4. The flexible packaging substrate of claim 1, wherein the total layer thickness of primer and ink layer(s) is comprised between 0.4 and 4 μ, preferably between 0.6 and 3.5 μ, more preferably between 0.8 and 3 μ.

5. The flexible packaging substrate of claim 1, wherein the layer thickness of the primer is comprised between 0.01 and 0.5 μ, preferably between 0.05 and 0.4 μ and most preferably between 0.1 and 0.3 μ.

6. A method for forming a printed flexible packaging substrate according to claim 1 comprising the steps of:

a. providing a flexible packaging substrate;

b. applying at least one digital print by a digital printing process of at least one ink composition, said ink composition having a concentration of ethylenically unsaturated groups, preferably (meth)acrylic double bonds and a concentration of alicyclic epoxides of less than 0.2 meq/g, preferably less than 0.1 meq/g, more preferably less than 0.05 meq/g, most preferably less than 0.01 meq/g;

c. subjecting the digital print to an electron beam irradiation.

7. The method according to claim 6, wherein the at least one ink composition is substantially free of components comprising molecular structures with dangling and/or end-standing ethylenically unsaturated double bonds.

8. The method according to claim 6, wherein the flexible packaging substrate is plasma treated, preferably corona plasma treated.

9. The method according to claim 6, comprising the additional step of applying a primer composition before initiating step b).

10. The method according to claim 6, wherein the digital printing process of step b) is liquid electrographic printing.

11. The method according to claim 6, wherein the electron beam irradiation dose in step c) is at least 15 kGy, preferably at least 18 kGy, more preferably at least 20 kGy.

12. The method according to claim 6, wherein the electron beam irradiation dose in step c) is comprised between 20 and 100 kGy, preferably between 25 and 80 kGy, more preferably between 30 and 60 kGy.

13. The method according to claim 6, wherein the electron beam irradiation in step c) is performed at an oxygen concentration of less than 300 ppm, preferably less than 250 ppm, more preferably less than 200 ppm, most preferably less than 150 ppm.

14. The method according to claim 6, wherein the flexible packaging substrate of step a) comprises polyethylene terephthalate, high density polyethylene, oriented polypropylene, oriented polyamide, polystyrene or paper.

15. The method according to claim 6, wherein the primer composition comprises one or more polyacrylamide(s).

16. The method according to claim 6, wherein the ink formulation comprises one or more (meth)acrylic (co)polymer(s) resin(s).

17. The method according to claim 6, wherein the ink formulation comprises:

from 20 to 95% by weight of hydrocarbon carrier liquid, from 5 to 80% by weight of one or more (meth)acrylic (co)polymer(s) resin(s), from 10 to 50% by weight of one or more carboxyl-functional ethylene comprising copolymer(s) co-resin (s) and from 0.1 to 80% by weight of one or more colorants.

18. The method according to claim 6, comprising the additional lamination step of the flexible packaging substrate to a seal layer.

19. The method according to claim 6, comprising the step of heat sealing the printed flexible substrate or the laminate in a heat sealing assembly at a temperature comprised between 100 and 250° C., preferably between 110 and 230° C., more preferably between 120 and 220° C.

20. Flow pack comprising the flexible packaging substrate according to claim 1.

* * * * *